US006797447B2

(12) United States Patent
Konya et al.

(10) Patent No.: US 6,797,447 B2
(45) Date of Patent: Sep. 28, 2004

(54) ELECTROSTATIC IMAGE DEVELOPER

(75) Inventors: Yoshiharu Konya, Annaka (JP); Koichiro Watanabe, Annaka (JP); Susumu Ueno, Takefu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 2 days.

(21) Appl. No.: 10/298,792

(22) Filed: Nov. 19, 2002

(65) Prior Publication Data

US 2003/0138716 A1 Jul. 24, 2003

(30) Foreign Application Priority Data

Nov. 19, 2001 (JP) ..... 2001-353135

(51) Int. Cl.[7] ..... G03G 9/08

(52) U.S. Cl. ..... 430/108.6; 430/108.7; 430/108.3

(58) Field of Search ..... 430/108.3, 108.6, 430/108.7

(56) References Cited

U.S. PATENT DOCUMENTS 4,855,204 A * 8/1989 Fujii et al. ..... 430/108.6
5,422,214 A 6/1995 Akiyama et al.
6,022,404 A * 2/2000 Ettlinger et al. ..... 106/404
6,130,020 A * 10/2000 Wada et al. ..... 430/108.6
6,248,495 B1 * 6/2001 Inokuchi et al. ..... 430/108.7
6,303,256 B1 * 10/2001 Kerner et al. ..... 430/108.6
6,638,674 B2 * 10/2003 Komoto et al. ..... 430/106.1

FOREIGN PATENT DOCUMENTS

EP 1 246 022 A2 10/2002

OTHER PUBLICATIONS

Kirk–Othmer Concise Encyclopedia of Chemical Technology. New York: John Wiley & Sons. (1985) pp. 1054–1055.*

* cited by examiner

*Primary Examiner*—Christopher RoDee
(74) *Attorney, Agent, or Firm*—Birch, Stewart, Kolasch & Birch, LLP

(57) ABSTRACT

By simultaneously atomizing a siloxane and two organometallic compounds of different metals M1 and M2 exclusive of silicon in a flame for combustion, spherical amorphous ternary complex oxide fine particles are obtained which are substantially free of chlorine, have a particle size of 10–500 nm, and have a silica content A of 1–99 wt %, a M1 oxide content B of 1–90 wt % and a M2 oxide content C of 1–90 wt %, all based on the weight of oxides excluding carbon, provided that A+B+C≈100. An electrostatic image developer comprising the fine particles is improved in fluidity and cleanability and bears a uniform and stable quantity of electric charge.

5 Claims, 1 Drawing Sheet

ELECTROSTATIC IMAGE DEVELOPER

This invention relates to a developer for developing electrostatic images in electrophotography and electrostatic recording process.

BACKGROUND OF THE INVENTION

Dry developers used in electrophotography and similar processes are generally divided into a one-component developer using a toner having a colorant dispersed in a binder resin alone and a two-component developer using the toner in admixture with a carrier. When these developers are used in copying operation, the developers must satisfy many factors such as fluidity, anti-caking, fixation, charging ability and cleanability in order that they adapt to the process.

For the purposes of improving the fluidity, anti-caking, fixation and cleanability, and adjusting and stabilizing the charging ability, at least two types of inorganic fine particles of silica, titania, alumina, zinc oxide, etc. having a smaller particle size than the toner particles are often added as the external additive.

As the copying speed is accelerated in the recent years, the developer is required to have more fluidity, cleanability, and stable and uniform charging ability. To produce images of better quality, the toner has shifted to a small particle size one. As compared with conventional toners commonly used in the art, the small particle size toner is poor in powder flow and its charging ability is readily altered by additives such as external additive. Then, depending on the type and particle size of inorganic fine particles such as silica fine particles added to the toner, the small particle size toner does not necessarily promise satisfactory results with respect to fluidity, charging ability and cleanability. A choice of the inorganic fine particles added thereto is important. Commonly used silica fine particles, whose mean particle size of primary particles is as small as 10 to 20 nm, are highly cohesive to each other and poorly dispersible, failing to meet the requirements of fluidity and cleanability. Using spherical silica fine particles is effective in improving fluidity and increasing the charge quantity, but due to an excessive charge quantity, the electrostatic adhesive force of fine particles to the toner support becomes stronger, resulting in a lowering of development, a lower image density and density variations. The silica fine particles used sometimes contain impurities, which affect the charging ability of the developer.

In addition to the silica fine particles, fine particles of titania, alumina or zinc oxide are further added for the purpose of controlling the charge quantity. However, crystalline fine particles are poor in fluidity and dispersibility due to their non-spherical shape, resulting in images being fogged (background staining). An attempt to add inorganic fine particles of at least two types as external additives to the toner particles was made for improving fluidity and cleanability and stabilizing charging ability. Because of fineness, these inorganic fine particles are difficult to disperse and mix uniformly, and result in a mixture of varying concentration which inevitably entails partial segregation. Due to a local varying degree of mixing, charging ability and cleanability become non-uniform. As a consequence, the desired effects are not fully exerted.

SUMMARY OF THE INVENTION

An object of the invention is to provide an electrostatic image developer having improved fluidity and cleanability as well as a stable charging ability.

We have found that amorphous ternary complex oxide fine particles are obtained by simultaneously atomizing a siloxane and two organometallic compounds of different metals M1 and M2 exclusive of silicon in a flame for combustion; that the ternary complex oxide fine particles consist essentially of silica and two metal oxides, are substantially free of chlorine, have a particle size of 10 to 500 nm, and have a silica content A of 1 to 99% by weight, a M1 oxide content B of 1 to 90% by weight and a M2 oxide content C of 1 to 90% by weight, all based on the weight of oxides excluding carbon, A+B+C≈100; and that when the ternary complex oxide fine particles are added as inorganic fine particles to toner particles, there is obtained an electrostatic image developer which exhibits smooth flow, effective cleaning and uniform and stable charging performance.

Accordingly, the invention provides an electrostatic image developer comprising amorphous spherical ternary complex oxide fine particles obtained by simultaneously atomizing a siloxane (which refers to an organopolysiloxane, hereinafter) and two organometallic compounds of different metals M1 and M2 exclusive of silicon in a flame for combustion, the fine particles being substantially free of chlorine, having a particle size of 10 to 500 nm, and having a silica content A of 1 to 99% by weight, a M1 oxide content B of 1 to 90% by weight and a M2 oxide content C of 1 to 90% by weight, all based on the weight of oxides excluding carbon, provided that A+B+C is substantially 100% by weight.

In a preferred embodiment, the ternary complex oxide consists essentially of silica and oxides of metals M1 and M2 as second and third components, the oxides of metals M1 and M2 being selected from among titanium oxide, alumina, zinc oxide, iron oxide, tin oxide, indium oxide, vanadium oxide, magnesium oxide, manganese oxide, boron oxide, cerium oxide, copper oxide, and nickel oxide.

In a preferred embodiment, the two organometallic compounds are selected from among alkoxy compounds, acylate compounds, alkyl compounds and chelate compounds of metals M1 and M2.

The complex oxide fine particles are preferably hydrophobized fine particles having introduced at their surface, units represented by the following formula (1):

$$R^1_xR^2_yR^3_zSiO_{(4-x-y-z)/2} \quad (1)$$

wherein $R^1$, $R^2$ and $R^3$ each are independently a substituted or unsubstituted monovalent hydrocarbon group having 1 to 6 carbon atoms, x, y and z each are an integer of 0 to 3, x+y+z is from 1 to 3.

DESCRIPTION OF THE PREFERRED EMBODIMENTS

Figure 1:
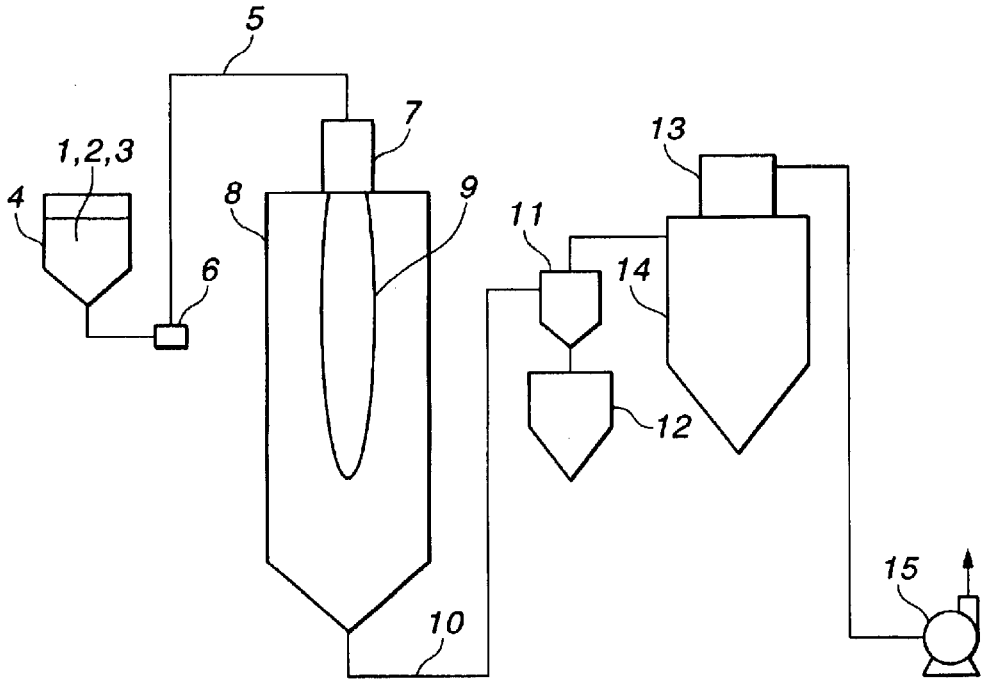
FIG. 1 schematically illustrates an exemplary reaction system for use in the preparation of ternary complex oxide fine particles according to the invention.

The electrostatic image developer of the invention is arrived at by adding spherical fine particles of amorphous, specific ternary complex oxide to toner particles.

The toner used herein may be any of well-known toners primarily comprising a binder resin and a colorant. If necessary, a charge controlling agent may be added to the toner. Examples of the binder resin used in the toner include homopolymers and copolymers of styrenes such as styrene, chlorostyrene and vinylstyrene, monoolefins such as ethylene, propylene, butylene and isobutylene, vinyl esters such as vinyl acetate, vinyl propionate, vinyl benzoate and vinyl lactate, acrylates and methacrylates such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, and ketones such as vinyl methyl ketone, vinyl hexyl ketone, and vinyl isopropenyl ketone, though the resin is not limited thereto. Typical binder resins are polystyrene, styrene-alkyl acrylate copolymers, styrene-acrylonitrile copolymers, styrene-butadiene copolymers, styrene-maleic anhydride copolymers, polyethylene and polypropylene. Besides, polyesters, polyurethanes, epoxy resins, silicone resins, polyamides, modified rosin, paraffin and wax are also useful.

The colorant used in the toner is not critical. Typical colorants include carbon black, Nigrosine dyes, Aniline Blue, Chalcoyl Blue, Chrome Yellow, Ultramarine Blue, Dupont Oil Red, Quinoline Yellow, Methylene Blue chloride, Phthalocyanine Blue, Malachite Green oxalate, lamp black, and Rose Bengale. Another useful toner powder is a magnetic toner powder having a magnetic material incorporated therein.

The spherical amorphous ternary complex oxide fine particles used herein consist essentially of silica and oxides of different metals M1 and M2 exclusive of silicon and are obtained by simultaneously atomizing a siloxane and two organometallic compounds of different metals M1 and M2 exclusive of silicon in a flame for combustion.

The siloxane used herein is typically an organosiloxane which is free of halogen such as chlorine, and selected, for example, from among linear organo(poly)siloxanes having the following general formula (2), cyclic organopolysiloxanes having the following general formula (3), and mixtures thereof.

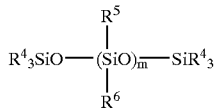

(2)

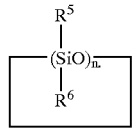

(3)

Herein each of $R^4$, $R^5$ and $R^6$ which may be the same or different is a monovalent hydrocarbon group, alkoxy or hydrogen, m is an integer inclusive of 0, and n is an integer of at least 3.

The monovalent hydrocarbon groups represented by $R^4$–$R^6$ include $C_1$–$C_6$ alkyl groups, alkenyl groups such as vinyl, and phenyl groups. Of these, lower alkyl groups such as methyl, ethyl and propyl are preferable, with methyl being most preferred. The alkoxy groups represented by $R^4$–$R^6$ are those of 1 to 6 carbon atoms, such as methoxy and ethoxy, with methoxy being most preferred. The letter m is an integer of $m \geqq 0$, preferably 0 to 100, and more preferably 0 to 8; and n is an integer of $n \geqq 3$, preferably 3 to 20, and more preferably 3 to 7.

Exemplary of the organosiloxane are hexamethyldisiloxane, octamethyltrisiloxane, octamethylcyclotetrasiloxane, and decamethylcyclopentasiloxane. These siloxanes are preferably purified products which are free of halogen (e.g., chlorine).

The different metals M1 and M2 include Ti, Al, Zn, Fe, Sn, In, V, Mg, Mn, B, Ce, Cu, and Ni. Of these, Ti, Al, and Zn are preferred.

The organometallic compounds are typically alkoxy compounds, acylate compounds, alkyl compounds and chelate compounds of metals M1 and M2, which are preferably substantially free of chlorine. More illustratively, useful organometallic compounds include:

alkoxy metal compounds of the following general formula (4):

$$M1(OR^7)_a \text{ or } M2(OR^7)_b \quad (4)$$

wherein $OR^7$ is an alkoxy group, preferably $C_{1-8}$ alkoxy group such as methoxy, ethoxy, propoxy, isopropoxy or butoxy, each of "a" and "b" is an integer of 2 to 4;

metal acylate compounds of the following general formula (5):

$$M1(OCOR^8)_a \text{ or } M2(OCOR^8)_b \quad (5)$$

wherein $COR^8$ is an acyl group such as formyl, acetyl, propionyl, butyryl, valeryl, caproyl, heptanoyl or octanoyl, each of "a" and "b" is an integer of 2 to 4;

alkyl metal compounds of the following general formula (6):

$$M1R^9_a \text{ or } M2R^9_b \quad (6)$$

wherein $R^9$ is an alkyl group, preferably $C_{1-8}$ alkyl group such as methyl, ethyl, propyl, butyl or pentyl, each of "a" and "b" is an integer of 2 to 4; and metal chelate compounds of the following general formula (7) or (8):

$$(R^{10}O)_pM1(OR^{11}OH)_q \text{ or } (R^{10}O)_pM2(OR^{11}OH)_q \quad (7)$$

$$(R^{10}O)_rM1(OR^{11}NH_2)_s \text{ or } (R^{10}O)_rM2(OR^{11}NH_2)_s \quad (8)$$

wherein $OR^{10}$ is an alkoxy group, preferably $C_{1-8}$ alkoxy group such as methoxy, ethoxy, propoxy, isopropoxy or butoxy, $R^{11}$ is an alkylene group of $C_{1-8}$, especially $C_{1-6}$, such as methylene, ethylene, propylene or butylene, each of p, q, r and s is an integer of 1 to 3, p+q is 2 to 4, and r+s is 2 to 4.

The organometallic compounds of M1 and M2 are preferably purified reagents which are free of halogen (e.g., chlorine) and sulfur. Due to the substantial absence of impurities and the high purity, they are best suited as the reactant to form a complex oxide.

In order that the siloxane and the organometallic compounds of M1 and M2 undergo complete and uniform oxidative combustion, the organometallic compounds of M1 and M2 should preferably be used in the liquid state so that they can be finely atomized. If combustion is carried out in solid powder form, combustion points are non-uniformly distributed to produce fine particles of differing composition, and combustion becomes incomplete, leaving more carbon in the particles.

Of the organometallic compounds of M1 and M2, those which are solid at room temperature are preferably dissolved in suitable solvents prior to use. Examples of suitable solvent include siloxanes; alcohols such as methanol, ethanol, n-propyl alcohol, isopropyl alcohol, n-butyl alcohol, isobutyl alcohol, sec-butyl alcohol, and tert-butyl alcohol; and hydrocarbon solvents such as hexane, cyclohexane, benzene, toluene, xylene, ethylbenzene, petroleum spirit (industrial gasoline) and kerosine.

The siloxane and the organometallic compounds of M1 and M2 may be fed as a liquid premix or separately fed in liquid form and mixed in an in-line mixer such as a static mixer disposed in the feed line.

In order that the ternary complex oxide having the three components, silica and M1 and M2 metal oxides uniformly dispersed in particles at predetermined concentrations allow the three components to exert their own function to a full extent, it should have a silica content A of 1 to 99% by weight, preferably 5 to 95% by weight, a M1 metal oxide content B of 1 to 90% by weight, preferably 1 to 80% by weight, and a M2 metal oxide content C of 1 to 90% by weight, preferably 1 to 80% by weight, all based on the total weight of oxides excluding carbon. It is noted that A+B+C is substantially 100% by weight. The amounts of the siloxane and the organometallic compounds of M1 and M2 mixed and fed are determined, based on the amounts of the respective components produced at the end of combustion, so that the ternary complex oxide may have the desired compositional ratio of the three components.

The liquid mixture of reactants is fed to a burner whereby the mixture is atomized from a nozzle at the tip of the burner. For the atomization of liquid, use may be made of an atomizing medium, the pressure of liquid itself or a centrifugal force. In the atomizing method using an atomizing medium, air, an inert gas such as nitrogen or steam may be used as the atomizing medium to assist in atomizing through the nozzle. If the organometallic compounds used are hydrolyzable, it is preferred to use dehumidified, compressed air or an inert gas such as nitrogen as the atomizing medium. To achieve complete vaporization and pyrolysis for combustion, the atomized droplets should be very small, preferably having a size of up to 100 $\mu$m, more preferably up to 50 $\mu$m. To this end, the reactant liquids (siloxane and organometallic compounds of M1 and M2) should preferably have a viscosity of up to 500 cs, more preferably up to 200 cs at 25° C.

The droplets of atomized siloxane and organometallic compounds of M1 and M2 are heated by their own combustion flame and by the auxiliary flame of a combustion-assisting gas, and undergo oxidative combustion concomitant with evaporation or pyrolysis. Synthesis of silica from the siloxane and synthesis of M1 and M2 metal oxides from the organometallic compounds of M1 and M2 occur simultaneously in the gas phase whereby silica and M1 and M2 metal oxides are coalesced and fused together, resulting in spherical ternary complex oxide fine particles in which the three components, silica and M1 and M2 metal oxides are uniformly dispersed and composited.

Combustion creates core particles of silica and M1 and M2 metal oxides which coalesce and grow into particles whose ultimate size and shape are determined by the flame temperature, the concentration of core particles in the flame, and the residence time of core particles within the flame. By changing the feed amount and ratio of a combustion-supporting gas, a combustion-assisting gas and the reactant liquid introduced from the burner, both the flame temperature and the concentration of core particles in the flame can be controlled. As the feed ratio of the reactant liquid relative to the combustion-supporting and assisting gases increases, the flame temperature rises and at the same time, the concentration of core particles in the flame increases so that the probability of mutual collision of core particles increases, promoting coalescence and growth of core particles into spherical complex oxide particles having a larger size. As the feed ratio of the reactant liquid diminishes, the flame temperature lowers and at the same time, the concentration of core particles in the flame lowers, resulting in spherical complex oxide particles having a smaller size.

For the flame temperature for promoting the coalescence and growth of core particles, the melting points of M1 and M2 metal oxides become a reference. At flame temperatures below the melting points of these oxides, the coalescence and growth of core particles is retarded so that the particle size becomes close to 10 nm, which is about the same as that of fumed silica, and control of the particle size becomes difficult. It is noted that the melting point of typical metal oxides is 1,423° C. for silica, 1,640° C. for titania, 2,054° C. for alumina, 1,975° C. for zinc oxide, 1,565° C. for iron oxide, and 1,970° C. for vanadium oxide. The adiabatic flame temperature is adjusted such that the flame temperature may be equal to or above the melting points of the oxides of which the ternary complex oxide is made up.

The flame temperature is largely affected by the heat of combustion and the amount of excessive oxygen (air). In the case of complete combustion, the heat of combustion is determined by the type and amount of the siloxane, the organometallic compounds of M1 and M2 and a combustion-assisting gas. The siloxane as the silica source provides a substantial heat of combustion and hence, a high energy efficiency, as seen from the fact that hexamethyldisiloxane, a linear siloxane, has a heat of combustion of 1,389 kcal/mol or 8,550 kcal/kg, and octamethylcyclotetrasiloxane, a cyclic siloxane, has a heat of combustion of 1,974 kcal/mol or 6,650 kcal/kg. The organometallic compounds of M1 and M2 also provide a substantial heat of combustion. For instance, of the organic titanium compounds, tetraisopropoxytitanium has a heat of combustion of 1,623 kcal/mol or 5,710 kcal/kg, and titanium acetylacetonate (or diisopropoxybisacetylacetonate) has a heat of combustion of 2,112 kcal/mol or 5,800 kcal/kg; of the organic aluminum compounds, tetraisopropoxyaluminum has a heat of combustion of 1,366 kcal/mol or 6,685 kcal/kg; of the organic zinc compounds, diisopropoxyzinc has a heat of combustion of 889 kcal/mol or 4,842 kcal/kg, and zinc octylate has a heat of combustion of 2,080 kcal/mol or 5,912 kcal/kg. Simultaneously burning the siloxane and the organometallic compounds creates a combustion flame with high thermal energy efficiency to promote the coalescence and growth of core particles into spherical particles.

To keep the combustion of siloxane and organometallic compounds of M1 and M2 stable and drive combustion to completion, an auxiliary flame is formed using a combustion-assisting gas. The combustion-assisting gas used here is preferably one which does not leave unburned residues following combustion. Suitable, non-limiting examples include hydrogen and hydrocarbon gases such as methane, propane and butane. However, a large amount of combustion-assisting gas results in the formation of combustion by-products such as carbon dioxide and steam, increasing the amount of combustion exhaust and reducing the concentrations of core oxide particles created in the flame. Accordingly, the amount of combustion-assisting gas is typically set at not more than 2 moles, and preferably from 0.1 to 1.5 moles, per mole of the starting reactants, siloxane and organometallic compounds combined.

Moreover, a combustion-supporting gas is added at the time of combustion. The combustion-supporting gas may be oxygen or an oxygen-containing gas such as air. If the net amount of oxygen in the gas is insufficient, combustion of the siloxane, the organometallic compounds of M1 and M2, and the combustion-assisting gas used in the auxiliary flame is incomplete, leaving carbon residues in the finished product. On the other hand, if a greater than stoichiometric amount of combustion-supporting gas is used, the concentrations of silica and M1 and M2 metal oxides within the flame decrease and the flame temperature falls, which tends to suppress coalescence and growth of core particles. Supplying a large excess of the combustion-supporting gas results in the incomplete combustion of the siloxane and organometallic compounds, and excessively increases the load on powder collecting equipment in the exhaust system. Supplying combustion-supporting gas which contains a stoichiometric amount of oxygen allows the highest flame temperature to be achieved, but combustion tends to be incomplete. A small excess of oxygen is required to achieve complete combustion. Accordingly, it is advantageous for the combustion-supporting gas fed from the burner to include a molar amount of oxygen which is 1.0 to 4.0 times, and preferably 1.1 to 3.0 times greater than the stoichiometric amount of oxygen required for combustion. In addition to the gas fed from the burner, the combustion-supporting gas may be supplemented by ambient air taken in along the burner.

The spherical, amorphous ternary complex oxide fine particles consisting essentially of silica and M1 and M2 metal oxides according to the invention should have a particle size of 10 to 500 nm, preferably 20 to 400 nm. If the particle size is less than 10 nm, then particles are likely to agglomerate, failing to provide the developer with satisfactory flowing, anti-caking and fixing capabilities. If the particle size is more than 500 nm, then there can occur modification and scraping of the photoconductor drum and decreased adhesion to the toner. The size of the spherical, amorphous ternary complex oxide fine particles consisting essentially of silica and M1 and M2 metal oxides and formed from combustion can be adjusted by varying the flame temperature and the concentrations of core particles of silica and M1 and M2 metal oxides created in the flame. Other than the foregoing, there are no limitations concerning the introduction of air or an inert gas such as nitrogen to prevent the deposition of powder on the walls of the combustion furnace or to cool the exhaust gases following combustion.

The furnace is operated under negative pressure while it is subjected to suction and exhaustion by means of an exhauster such as a blower disposed on the exhaust line. The ternary complex oxide fine particles thus obtained by combustion are carried on the exhaust gases and separated and collected by means of a cyclone, pneumatic classifier or bag filter provided along the exhaust line. The exhaust gases are drawn off by the exhauster. Since the siloxane and organometallic compounds of M1 and M2 are free of halogen, typically chlorine, combustion produces no acidic corrosive gases such as hydrogen chloride. The elimination of detrimental by-products is advantageous in that no special materials are needed to construct the furnace, duct, collector, container, exhauster and the like, and an exhaust gas treatment unit may be omitted.

In this way, amorphous ternary complex oxide fine particles are produced which consist essentially of silica and two M1 and M2 metal oxides, which are spherical in shape and substantially free of chlorine, which have a particle size of 10 to 500 nm, which have a silica content A of 1 to 99% by weight, a M1 oxide content B of 1 to 90% by weight and a M2 oxide content C of 1 to 90% by weight, all based on the weight of oxides excluding carbon, provided that A+B+C≈100, and which have a sphericity of at least 0.8 (i.e., 0.8 to 1), preferably at least 0.85 (i.e., 0.85 to 1), defined as a ratio of breadth to length of particles.

Preferably, the M1 and M2 metal oxides which are combined as the second and third components with silica are selected from among titanium oxide, alumina, zinc oxide, iron oxide, tin oxide, indium oxide, vanadium oxide, magnesium oxide, manganese oxide, boron oxide, cerium oxide, copper oxide, and nickel oxide.

To minimize the variation of charge quantity with temperature and humidity, the complex oxide fine particles of silica and two M1 and M2 metal oxides according to the invention are preferably hydrophobized, that is, fine particles having introduced at their surface units represented by the following formula (1):

$$R^1_xR^2_yR^3_zSiO_{4-x-y-z)/2} \quad (1)$$

wherein $R^1$, $R^2$ and $R^3$ each are independently a substituted or unsubstituted monovalent hydrocarbon group having 1 to 6 carbon atoms, x, y and z each are an integer of 0 to 3, x+y+z is from 1 to 3.

Examples of the hydrocarbon group represented by $R^1$, $R^2$ and $R^3$ include methyl, ethyl, propyl, butyl, pentyl, hexyl, cyclohexyl, phenyl, vinyl and allyl, with methyl being most preferred. The units of formula (1) can be introduced according to a well-known method of surface modifying silica fine powder. For example, a silazane compound represented by the formula: $R^1_3SiNHSiR^1_3$ is heated at a temperature of 50 to 400° C. in a gas, liquid or solid phase in the presence of water, for removing the excessive silazane compound.

Examples of the silazane compound: $R^1_3SiNHSiR^1_3$ include hexamethyldisilazane, hexaethyldisilazane, hexapropyl-disilazane, hexabutyldisilazane, hexapentyldisilazane, hexahexyldisilazane, hexacyclohexyldisilazane, hexaphenyl-disilazane, and divinyltetramethyldisilazane. Among others, hexamethyldisilazane is most preferred for hydrophobic property achievable by modification and ease of its removal.

The electrostatic image developer of the invention is obtainable by adding the spherical ternary complex oxide fine particles to toner particles. The amount of the complex oxide fine particles blended is preferably 0.01 to 20 parts by weight, more preferably 0.1 to 10 parts by weight per 100 parts by weight of the toner particles. Less than 0.01 part of the oxide fine particles are insufficient to improve the fluidity of toner particles whereas more than 20 parts of the oxide fine particles adversely affect the charging ability. If necessary, additives such as a charge controlling agent, parting agent and wax may be blended in the developer.

These components may be mixed by any desired method. Use is made of, for example, rotary type mixers such as V-type mixers and double cone mixers, impeller mixers such as ribbon mixers and screw mixers, high-speed shear flow type mixers, and ball mills. As a result of mixing, the complex oxide fine particles may be either attached or fused to surfaces of the toner particles.

The electrostatic image developer comprising spherical ternary complex oxide fine particles of silica and M1 and M2 metal oxides according to the invention may be used as a one-component developer. It may also be used as a two-component developer after further mixing with a carrier. In the application as two-component developer, the toner may also be surface coated with the spherical ternary complex oxide fine particles by adding the oxide fine particles during the mixing of the toner and the carrier rather than previously adding the oxide fine particles to the toner. The carrier is in the form of particles having a mean particle size which is close to the particle size of the toner or up to 300 $\mu$m. Any well-known carrier may be used, for example, iron, nickel, cobalt, iron oxide, ferrite, glass beads, and particulate silicon. The carrier particles may be surface coated with fluororesins, acrylic resins or silicone resins.

The electrostatic image developer of the invention can be used in developing electrostatic latent images on photoconductor drums or dielectric-coated (electrostatic recording) media. More particularly, electrostatic latent images are electrophotographically formed on photoconductor drums made of inorganic photoconductive materials such as selenium, zinc oxide, cadmium sulfide and amorphous silicon, or organic photoconductive materials such as phthalocyanine pigments and bisazo pigments. Alternatively, electrostatic latent images are formed on dielectric-coated media having polyethylene terephthalate derivatives or the like by a needle electrode or the like. Then a developing process such as a magnetic brush, cascade or touch-down process is used to apply the electrostatic image developer of the invention to the electrostatic latent images for attaching the toner thereto.

The resulting toner images are then transferred to transfer media such as paper and fixed thereto to form duplicates. The residual toner on the surface of the photoconductor drum or the like is cleaned by a suitable process such as a blade, brush, web or roll process.

Referring to FIG. 1, there is schematically illustrated a reaction system for use in the preparation of ternary complex oxide fine particles of silica and M1 and M2 metal oxides according to the invention. The system is used to carry out a process for preparing ternary complex oxide particles, which process involves introducing a liquid mixture of siloxane and organometallic compounds of M1 and M2 to a burner and atomizing the liquid mixture through the burner for combustion.

In FIG. 1, a pressurized tank 4 contains a liquid mixture of the siloxane 1, M1 organometallic compound 2 and M2 organometallic compound 3. The liquid mixture is fed from the pressurized tank 4 to a burner 7 through an inlet line 5 while it is metered by a flow rate controller 6 in the line 5. The burner 7 is equipped with a nozzle (not shown), through which the liquid mixture is atomized into a vertical combustion furnace 8 where it is ignited with an auxiliary flame to form a combustion flame 9. As a result of combustion, ternary complex oxide fine particles consisting essentially of silica and M1 and M2 metal oxides are produced and carried on exhaust gases to enter a duct 10 where the particles are cooled. The fine particle-carrying exhaust gas stream enters a pneumatic classifier 11 and then a bag filter 13 where the particles are separated and collected in containers 12 and 14. The exhaust gases are drawn off by an exhauster 15.

FIG. 1 illustrates the embodiment wherein the siloxane and two organometallic compounds are premixed before the mixture is fed to the burner. Alternatively, the respective reactants may be separately fed and mixed in a static mixer or in-line mixer on the way to the burner.

EXAMPLE

Examples of the invention are given below by way of illustration and not by way of limitation.

Examples 1–7

A liquid reactant mixture was prepared by selecting one of hexamethyldisiloxane and octamethylcyclotetrasiloxane as the siloxane, and two of tetraisopropoxytitanium (colorless liquid), tri-sec-butoxyaluminum (pale yellow liquid) and a 65 wt % petroleum spirit solution of zinc octylate (white solid) as the organometallic compounds, and mixing these three components in predetermined concentrations. The reactant mixture was fed at room temperature to a burner 7 on top of a vertical combustion furnace 8 as shown in FIG. 1. From an atomizing nozzle mounted at the tip of the burner 7, the mixture was atomized as a fine mist with the aid of nitrogen as the atomizing medium and combustion was induced by an auxiliary flame obtained by burning propane as the combustion-assisting gas. Oxygen and air were fed from a different inlet port in the burner 7 as the combustion-supporting gas. The mixing ratio of siloxane and M1 and M2 organometallic compounds, and the feed rates of the mixture, propane, oxygen, air and atomizing nitrogen in each example are shown in Table 1. Combustion produced ternary complex oxide fine particles consisting essentially of silica and M1 and M2 metal oxides, which are carried over with the exhaust gases to a duct 10 where the particles were cooled, then to a pneumatic classifier 11 and a bag filter 13 where the particles were separated and collected in containers 12 and 14. The exhaust gases were drawn off by an exhauster 15.

The ternary complex oxide fine particles, 500 g, were placed in a 5-liter high-speed agitation mixer equipped with a heating/cooling jacket. While agitating at 500 rpm, 25 g of deionized water was sprayed and fed to the particles in a closed state. Agitation was continued for 10 minutes. Subsequently, 25 g of hexamethyldisilazane was added and agitation was continued for a further 60 minutes in the closed state. With agitation, the particles were then heated at 150° C. and nitrogen was flowed for removing the ammonia gas formed and the residual agent, obtaining hydrophobized ternary complex oxide fine particles.

The hydrophobized complex oxide fine particles were analyzed by X-ray diffractometry, finding no crystalline phase, that is, the particles were amorphous. The particle size was measured by scanning electron microscopy (SEM). The particle shape on the resulting micrograph was analyzed using a particle shape analyzer Luzex F (manufactured by Nireco Co., Ltd.), from which all the particles were found to be spherical with a sphericity or breadth-to-length ratio of at least 0.85. The measurements of particle size are given in Table 1. The chlorine impurity content was less than 0.1 ppm, as measured by ion chromatography.

Next, 4 parts by weight of colorant Carmine 6BC was added to 96 parts by weight of a polyester resin having Tg of 60° C. and a softening point of 110° C. They were melt milled, followed by grinding and classification. Toner particles having a mean particle size of 7 $\mu$m were obtained. The toner, 40 g, was mixed with 1 g of the hydrophobized spherical complex oxide fine particles in a sample mill, obtaining a developer. The developer was examined for fluidity, cleanability, and charging stability by the following tests. The results of evaluation are also shown in Table 1.

Comparative Example 1

Three separate fine powders of silica, titania and alumina which had been hydrophobized as in Examples were blended to the same composition as the ternary complex oxide in Example 1. By adding this power mixture to the toner as in Example 1, a developer was prepared. Table 2 shows the fluidity, cleanability and charging stability of the developer.

Evaluation of Fluidity

Cohesiveness was measured, from which fluidity was evaluated. The instrument used was Multi-Tester by Seishin Kigyo K. K. A developer, 3 g, was placed on a measurement unit having three sieves with an opening of 250 $\mu$m, 150 $\mu$m and 75 $\mu$m stacked from top, which was vibrated at an amplitude of 1 mm for 60 seconds. Provided that $W_1$, $W_2$ and $W_3$ are the weights (all in gram) of powder fractions left on the upper, intermediate and lower sieves, respectively, cohesiveness is given by the following equation. A powder with a cohesiveness of less than 6% is regarded satisfactory.

$$\text{Cohesivenss } (\%)=(W_1+W_2\times 0.6+W_3\times 0.2)\times 100/3$$

Evaluation of Cleanability

A printer equipped with an organic photoconductor drum was used. A two-component developer was prepared by admixing 100 parts by weight of the developer with 8 parts by weight of a carrier obtained by coating ferrite cores of 50 μm in diameter with a mixture of a perfluoroalkyl acrylate resin and an acrylic resin. By loading the two-component developer printer with the two-component developer as a starter and the developer as a replenisher, a printing test of 10,000 sheets of paper was conducted. The adhesion of the developer to the photoconductor drum was reflected by white spots in full solid images.

Evaluation of Charging Stability

By loading a one-component developer printer with the one-component developer in Example, a printing test of 10,000 sheets of plain paper was conducted. On the image transferred and fixed to plain paper, a fog level was measured using a color difference meter.

TABLE 1

| | Example 1 | Example 2 | Example 3 | Example 4 | Example 5 | Example 6 |
|---|---|---|---|---|---|---|
| Feedstock | | | | | | |
| Type of siloxane | hexamethyl-disiloxane | hexamethyl-disiloxane | hexamethyl-disiloxane | octamethyl-cyclotetra-siloxane | hexamethyl-disiloxane | hexamethyl-disiloxane |
| Type of organometallic compound M1 solution | tetraiso-propoxy-titanium | tetraiso-propoxy-titanium | tetraiso-propoxy-titanium | tetraiso-propoxy-titanium | tetraiso-propoxy-titanium | 65% zinc octylate solution |
| Type of organometallic compound M2 solution | 65% zinc octylate solution | 65% zinc octylate solution | 65% zinc octylate solution | 65% zinc octylate solution | 60% tri-sec-butoxy-aluminum solution | 60% tri-sec-butoxy-aluminum solution |
| Mixing weight ratio of siloxane:organometallic compound M1: organometallic compound M2 | 56:27:17 | 56:27:17 | 56:27:17 | 30:43:27 | 4:46:50 | 34:48:18 |
| Feed rate | | | | | | |
| Feed rate of mixture (kg/h) | 5.2 | 7.5 | 9.8 | 6.8 | 7.0 | 6.4 |
| Feed rate of propane ($Nm^3$/h) | 0.3 | 0.2 | 0.1 | 0.2 | 0.2 | 0.2 |
| Feed rate of atomizing nitrogen ($Nm^3$/h) | 1.5 | 1.7 | 2.0 | 1.6 | 1.7 | 1.6 |
| Feed rate of oxygen ($Nm^3$/h) | 10.0 | 13.0 | 16.0 | 12.0 | 13.0 | 13.0 |
| Feed rate of air ($Nm^3$/h) | 36.0 | 28.0 | 19.0 | 28.0 | 25.0 | 26.0 |
| Particles produced | | | | | | |
| Silica content (wt %) | 80.3 | 80.3 | 80.3 | 60.1 | 11.3 | 69.7 |
| M1 oxide content (wt %) | 14.7 | 14.7 | 14.7 | 29.9 | 49.3 | 20.0 |
| M2 oxide content (wt %) | 4.9 | 4.9 | 4.9 | 10.0 | 39.4 | 10.3 |
| Particle size distribution (nm) | 20–130 | 60–350 | 80–450 | 50–270 | 40–250 | 60–300 |
| Properties | | | | | | |
| Fluidity (cohesiveness %) | 5.0 | 3.7 | 3.2 | 4.1 | 4.4 | 3.6 |
| Cleanability | no white spots | no white spots | no white spots | no white spots | no white spots | no white spots |
| Charging stability (fog level %) | 1.1 | 1.3 | 1.5 | 1.3 | 1.2 | 1.3 |

TABLE 1

| | | | Comparative Example 1 |
|---|---|---|---|
| Powders used | Type of silica | State | amorphous |
| | | Particle size (nm) | 10–20 |
| | Type of titania | State | crystalline (rutile type) |
| | | Particle size (nm) | 20–50 |
| | Type of zinc oxide | State | amorphous |
| | | Particle size (nm) | 20–50 |
| Composition | Amount of silica powder added (wt %) | | 80.3 |
| | Amount of titania powder added (wt %) | | 14.7 |
| | Amount of zinc oxide powder added (wt %) | | 4.9 |
| Properties | Fluidity (cohesiveness) | | 22.0 |
| | Cleanability | | white spots |
| | Charging stability (fog level %) | | 8.9 |

There has been described an electrostatic developer which flows smoothly, is readily cleanable and bears a uniform and stable quantity of electric charge.

Japanese Patent Application No. 2001-353135 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. An electrostatic image developer comprising spherical amorphous ternary complex oxide fine particles obtained by simultaneously atomizing a siloxane free of chlorine and two organometallic compounds of different metals M1 and M2 exclusive of silicon and free of chlorine in a flame for combustion, said fine particles being substantially free of chlorine, having a particle size of 10 to 500 nm, and having a silica content A of 1 to 99% by weight, an M1 oxide content B of 1 to 90% by weight and an M2 oxide content C of 1 to 90% by weight, all based on the weight of oxides excluding carbon, provided that A+B+C is substantially 100% by weight.

2. The developer of claim 1 wherein the complex oxide fine particles are hydrophobized fine particles having introduced at their surface units represented by the following formula (1):

$$R^1_xR^2_yR^3_zSiO_{(4-x-y-z)/2} \quad (1)$$

wherein $R^1$, $R^2$ and $R^3$ each are independently a substituted or unsubstituted monovalent hydrocarbon group having 1 to 6 carbon atoms, x, y and z each are an integer of 0 to 3, x+y+z is from 1 to 3.

3. An electrostatic image developer comprising spherical amorphous ternary complex oxide fine particles obtained by simultaneously atomizing a siloxane free of chlorine and two organometallic compounds of different metals M1 and M2 exclusive of silicon and free of chlorine in a flame for combustion, said fine particles being substantially free of chlorine, having a particle size of 10 to 500 nm, and having a silica content A of 1 to 99% by weight, an M1 oxide content B of 1 to 90% by weight and an M2 oxide content C of 1 to 90% by weight, all based on the weight of oxides excluding carbon, provided that A+B+C is substantially 100% by weight; wherein the ternary complex oxide consists essentially of silica and oxides of metals M1 and M2 as second and third components, the M1 and M2 metal oxides being selected from the group consisting of titanium oxide, alumina, zinc oxide, iron oxide, tin oxide, indium oxide, vanadium oxide, magnesium oxide, manganese oxide, boron oxide, cerium oxide, copper oxide, and nickel oxide.

4. An electrostatic image developer comprising spherical amorphous ternary complex oxide fine particles obtained by simultaneously atomizing a siloxane free of chlorine and two organometallic compounds of different metals M1 and M2 exclusive of silicon and free of chlorine in a flame for combustion, said fine particles being substantially free of chlorine, having a particle size of 10 to 500 nm, and having a silica content A of 1 to 99% by weight, an M1 oxide content B of 1 to 90% by weight and an M2 oxide content C of 1 to 90% by weight, all based on the weight of oxides excluding carbon, provided that A+B+C is substantially 100% by weight;

wherein the two organometallic compounds are selected from the group consisting of alkoxy compounds, acylate compounds, alkyl compounds and chelate compounds of metals M1 and M2.

5. The developer of claim 3, wherein the two organometallic compounds are selected from the group consisting of alkoxy compounds, acylate compounds, alkyl compounds and chelate compounds of metals M1 and M2.

* * * * *